US006413063B1

(12) United States Patent
Parsch et al.

(10) Patent No.: US 6,413,063 B1
(45) Date of Patent: Jul. 2, 2002

(54) PUMP

(75) Inventors: Willi Parsch, Bickenbach; Dirk Webert, Bad Homburg, both of (DE)

(73) Assignee: LUK Fahrzeug-Hydraulik GmbH & co. KG, Bad Homburg (DE)

( * ) Notice: Subject to any disclaimer, the term of this patent is extended or adjusted under 35 U.S.C. 154(b) by 0 days.

(21) Appl. No.: 09/762,120

(22) PCT Filed: Aug. 13, 1999

(86) PCT No.: PCT/DE99/02508

§ 371 (c)(1),
(2), (4) Date: Feb. 2, 2001

(87) PCT Pub. No.: WO00/09887

PCT Pub. Date: Feb. 24, 2000

(30) Foreign Application Priority Data

Aug. 13, 1998 (DE) ..... 298 23 904 U

(51) Int. Cl.[7] ..... F03C 2/00

(52) U.S. Cl. ..... 418/133; 418/132; 417/87; 417/189

(58) Field of Search ..... 418/133, 132; 417/87, 189

(56) References Cited

U.S. PATENT DOCUMENTS

| | | | | |
|---|---|---|---|---|
| 1,660,287 A | | 2/1928 | Willers | |
| 3,311,064 A | | 3/1967 | Eichele et al. | |
| 3,702,642 A | * | 11/1972 | Greene | 188/44 |
| 5,496,152 A | * | 3/1996 | Heise et al. | 417/187 |
| 5,702,243 A | * | 12/1997 | Gerlach | 418/133 |

FOREIGN PATENT DOCUMENTS

| | | | | |
|---|---|---|---|---|
| CA | 962131 | * | 2/1975 | 418/133 |
| DE | 26 22 164 A1 | | 12/1977 | |
| DE | 3938029 A1 | | 8/1990 | |
| DE | 4122433 A1 | | 1/1993 | |
| DE | 4138516 A1 | | 5/1993 | |
| EP | 68354 | * | 1/1983 | 418/133 |

* cited by examiner

*Primary Examiner*—Thomas Denion
*Assistant Examiner*—Theresa Trieu
(74) *Attorney, Agent, or Firm*—Alston & Bird LLP

(57) ABSTRACT

A rotary vane pump for delivering a fluid, having a delivery device (1) accommodated in a casing (2), with the casing (2) being closed on the one side by a casing cover (3), and on the other side by a bearing flange (4). A drive shaft (11) extends through the bearing flange (4), the delivery device (1), and optionally the casing (2), and is supported in a passageway formed in the bearing flange (4) and optionally in the casing cover (3). Also, between the delivery device (1) and the inside wall of the bearing flange (4), a side plate (16) is arranged, which supports itself on the inside wall, and centers the delivery device (1) in the casing (2). The side plate (16) is centered on the side facing the bearing flange (4) by a centering collar which extends into the passageway for the drive shaft (11).

6 Claims, 2 Drawing Sheets

PUMP

BACKGROUND OF THE INVENTION

The invention relates to a rotary vane pump for delivering a fluid.

Pumps of the described type are known and described for example in DE 39 28 029 A1, DE 41 22 433 C2, and DE 41 38 516 A1 and corresponding U.S. Pat. No. 5,496,152. Such pumps are commonly used, for example, in power steering systems, where they deliver a special oil for purposes of assisting the steering force being applied to the steering wheel of an automobile. Preferably, the pumps take in oil from a reservoir provided outside of the pump, for example, an external tank, and the pumps are equipped with a flow control valve, which permits delivering oil from the high-pressure zone, i.e. delivery side, to the intake zone, i.e. suction side, of the pump. Effective a certain rotational speed of the pump, and with a constantly adjustable delivery, the flow control valve opens a discharge bore, which allows oil to exit under high pressure. The oil reaches the suction zone of the delivery device.

DE 41 38 516 A1 discloses a rotary vane pump, wherein the drive shaft extends through the bearing flange and is there supported by suitable bearings. At its end arranged in the interior of the casing, the drive shaft is mounted for rotation in a pressure plate support. A suitable compression spring, which is supported on the one hand in the pressure plate support and on the other hand on the casing, pushes the pressure plate support against a pressure plate, which in turn lies against a rotor mounting a plurality of vanes. The vanes are supported for radial displacement in corresponding slots, which are arranged in the rotor.

The side of the delivery device corotating with the drive shaft, which faces the bearing flange i.e. the rotor in the present case, engages a side plate, which is supported on the bearing flange on its side facing away from the rotor. For centering the side plate and, thus, the delivery device or the rotor, the side plate is provided in a conventional manner with special centering means, which are concretely designed and constructed as centering pins on the side of the side plate facing the bearing flange, and which extend into corresponding bores in the bearing flange.

Centering of the side plate in the pump as known from DE 41 38 516 A1 is problematic in practice, since this centering and, thus, the means used for centering must be adapted exactly to the passageway formed in the bearing flange for receiving the shaft. From a constructional viewpoint, this is expensive and cannot always be realized in a reliable manner, so that there are quite considerable reference tolerances with respect to the casing.

It is therefore the object of-the present invention to improve and further develop a pump of the described type such that it permits a simple centering of the side plate or side plates, while reducing reference tolerances with respect to the shaft center or center of the bearing.

SUMMARY OF THE INVENTION

The above objects and advantages of the invention are achieved by a rotary vane pump of the described type and wherein the side plate is centered directly in the passageway for the drive shaft.

As a result, it has been recognized that one has to depart from the conventional centering of the side plate by means of centering pins to be able to reduce reference tolerances with respect.to the shaft center or center of the bearing effectively. If one centered the side plate in the conventional way by means of centering pins on the end face, the passageway in the bearing flange would have to be in exact alignment with the passageway in the side plate. This is costly from the viewpoints of manufacture and assembly, inasmuch as the side plate is manufactured and assembled separately from the bearing flange, and the position of the centering pins is responsible for the arrangement thereof relative to the bearing flange.

It has further been recognized in accordance with the invention that it is possible to avoid reference tolerances with respect to the casing, in that the side plate is centered relative to the passageway for the drive shaft, namely in that the side plate is centered on the side facing the bearing flange directly before, or on, or in the passageway for the drive-shaft. Such a direct centering of the side plate in the passageway for the drive shaft has the advantage that centering occurs no longer by means of separate centering pins, but just directly in the passageway, so that the necessary alignment is realized quasi automatically.

At this point, it should be remarked that in the case of the pump as disclosed in DE 41 38 516 A1, the drive shaft extends through the bearing flange into the delivery device, or through the delivery device, and that it is.supported on the opposite end. However, it is likewise possible that the drive shaft extends not only through the delivery device, but also through the casing cover on the side of the delivery device opposite to the bearing flange. In a corresponding manner, similarly to the bearing flange, a passageway or a bore is formed in the casing cover, through which the drive shaft extends. Accordingly, within the scope of such a construction, the drive is supported not only in the passageway of the bearing flange, but also in the passageway of the casing cover. In this instance, a side plate supporting itself on the inside wall is arranged respectively between the delivery device and inside wall of both the bearing flange and the casing cover, so that the drive unit is bounded and centered on both sides by a side plate, often also referred to as a pressure plate in the printed references of the prior art.

Based on the foregoing statements, is also quite possible that the side plate is centered directly in the passageway for the drive shaft not only on the side facing the bearing flange, but also on the side facing the casing cover. This applies-in particular when the drive shaft extends completely through the casing and, thus, likewise through the casing cover. Irrespective of the concrete form of construction, namely whether the drive shaft extends on both sides through the bearing flange and the casing cover, it will be very advantageous for centering the side plate to utilize on its side facing the passageway an at least essentially circumferential centering collar, which is inserted into the passageway. The centering collar defines the passageway in the side plate, so that the insertion of the centering collar into the passageway of the bearing flange and, optionally, into the casing cover automatically realizes a centering or positioning of the side plate. The centering collar could be constructed in part, or in segments, or be made continuous.

In a further advantageous manner, the side plate comprises an antirotation device, which could be the centering collar itself when constructed in an antirotational manner. Within the scope of a partial configuration of the centering collar, same in turn could be used as an antirotation device, namely when the passageway for inserting the centering collar is provided with corresponding measures for stopping the partially configured centering collar.

It is likewise possible that the antirotation device comprises special engagement means on the side of the side plate, which faces the passageway. These engagement means may also be formed directly in the region of the centering collar. They may be, for example, projections that engage corresponding recesses in the inside wall of the bearing flange, or the casing cover, and/or the passageway. At any rate, the foregoing constructional measures permit realizing a simple centering of the side plate, while providing at the same time an antirotation device, so that the side plate is centered in an ideal manner, with simple constructional means.

There exist various possibilities of improving and further developing the teaching of the present invention in an advantageous manner. To this end, reference may be made to the following description of an embodiment of the invention with reference to the drawing. Likewise, in conjunction with the description of the preferred embodiment of the invention with reference to the drawing, generally preferred improvements and further developments of the teaching are described in greater detail.

DETAILED DESCRIPTION OF A PREFERRED EMBODIMENT

Figure 1:
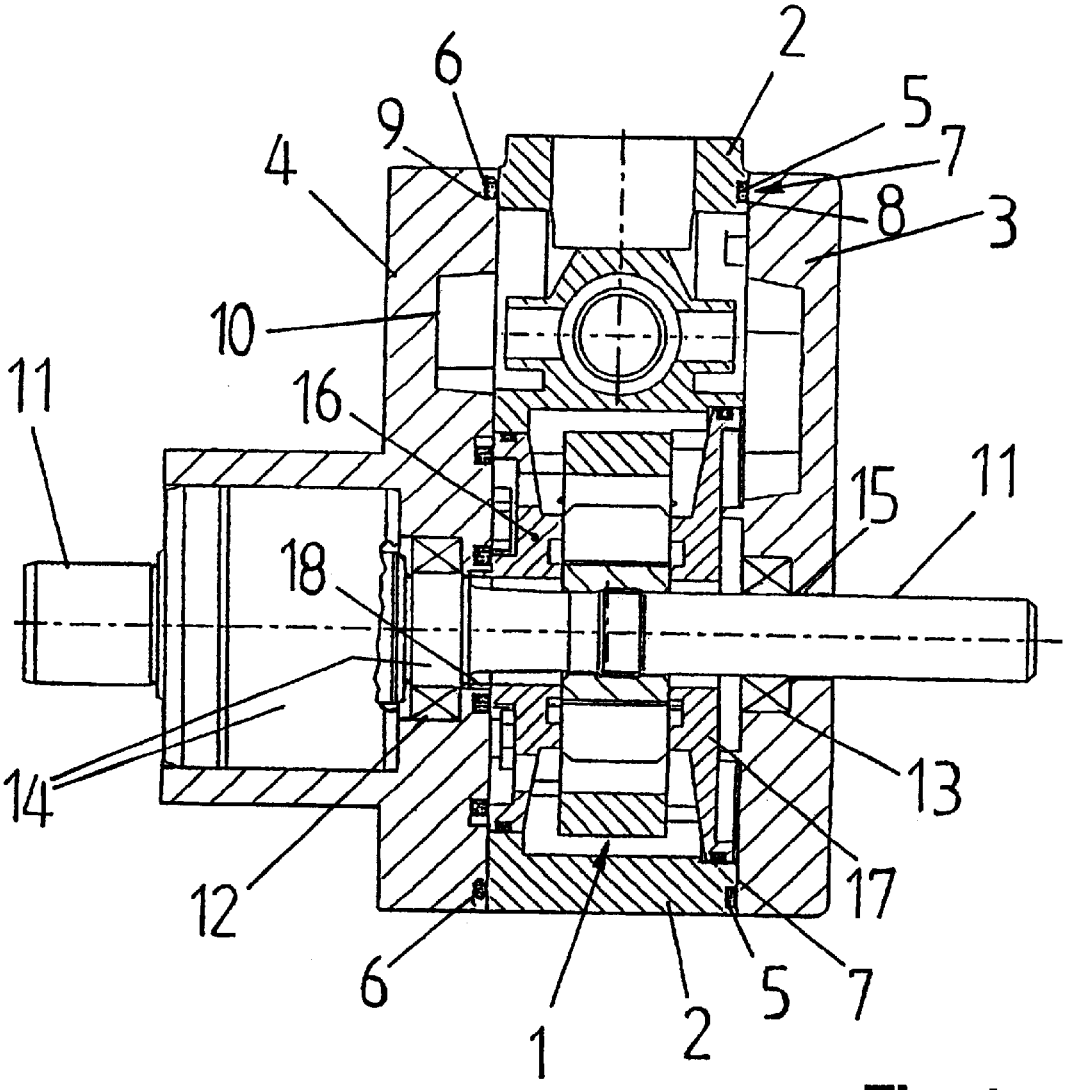
FIG. 1 is a schematic, sectional side view of an embodiment of a pump according to the invention.

FIG. 1 shows in a simplified illustration a sectional side view of a rotary vane pump. Specifically, the pump is a pump with a rotary group 1 or delivery device not described in greater detail. As regards the special configuration of such a rotational group 1, reference may be made, for example, to DE 41 38 516 A1.

The pump illustrated in the drawing comprises as essential parts, a casing 2 and a delivery device accommodated in casing 2, which is the aforesaid rotary group 1. On the end faces, a casing cover 3 closing the casing 2 is provided on the one side, and a bearing flange 4 adjoining the casing 2 on the other side, i.e. on the side opposite to the casing cover 3.

Between the casing 2 and the casing cover 3 on the one hand, and the casing 2 and bearing flange 4 on the other hand, an outwardly operative seal 5, 6 is arranged. In this arrangement, the seal 5 operating toward the casing cover 3 is inserted into a groove 8 formed in an end face 7 of casing 2. On the other side of casing 2, the seal 6 is associated to bearing flange 4 or inserted into a groove 9 provided in the bearing flange 4. The groove 9 could likewise be formed in an end face 10 of casing 2.

A drive shaft 11 extends through the bearing flange 4, the delivery device 1, and the casing cover 3. To support the drive shaft 11, special bearings are provided on the one hand in bearing flange 4 and on the other hand in casing cover 3. In the casing cover 3, a bore or passageway 15 itself embodies the bearing. Inward adjoining thereto are radial seals 13. On the opposite side, the bearing is formed in the passageway 14 of bearing flange 4. Likewise here, radial seals 12 adjoin toward the inside.

Between the delivery device 1 and the inside wall of both bearing flange 4 and casing cover 3, side plates 16, 17 are arranged respectively, which support themselves on the inside wall, and center the delivery device 1 in casing 2. The side plates 16, 17 are used, among other things, not only for centering the delivery device 1, but also primarily for providing a separation between the suction and the delivery side.

Figure 2:
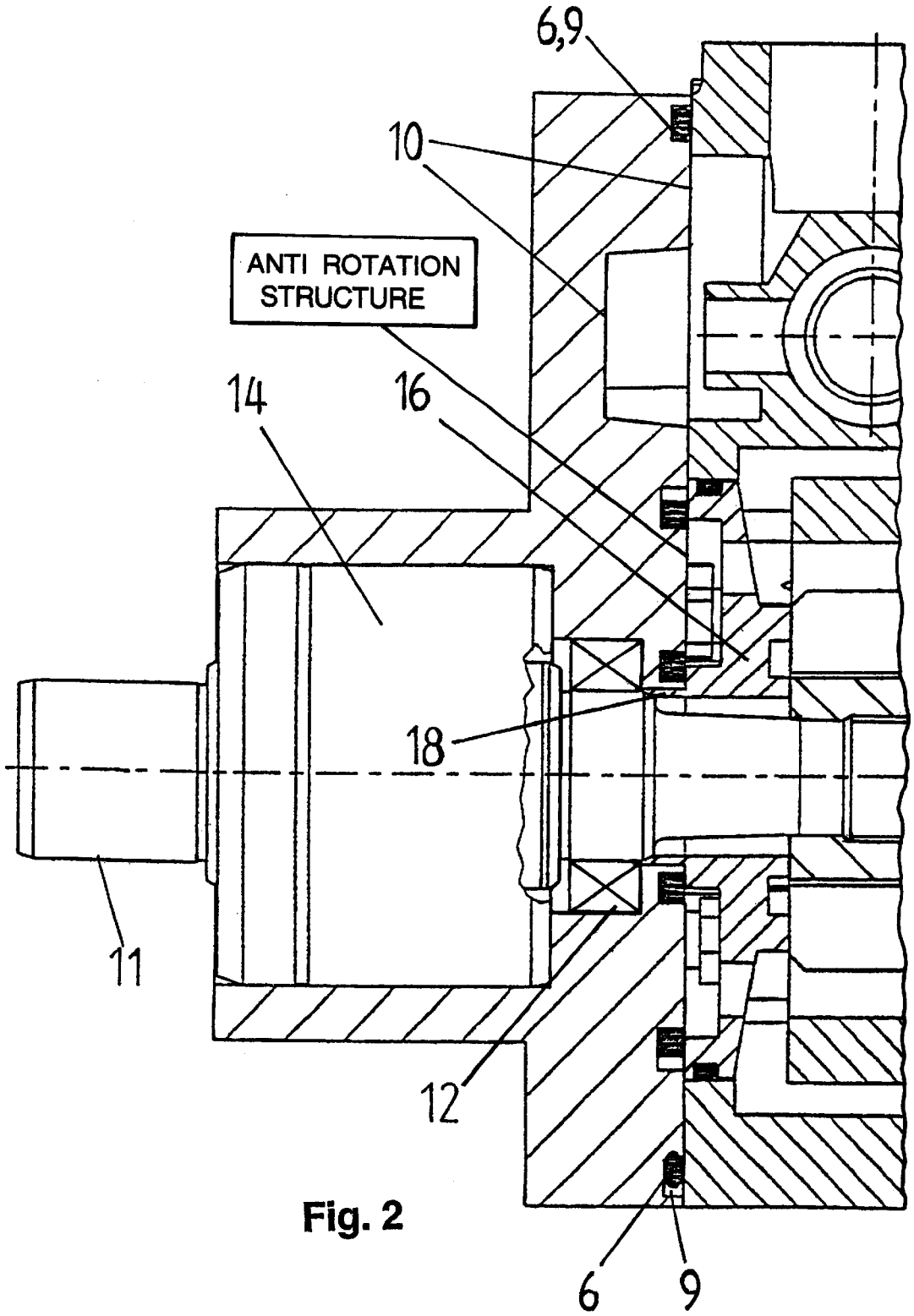
FIG. 2 is an enlarged view of the subject matter shown in FIG. 1, which shows the centering of the side plate on the bearing side in the passageway of the shaft.

In accordance with the invention, the side plate 16 is centered, at least on the side facing the bearing flange 4, directly in a region adjoining the passageway 14 inward, as best seen in FIG. 2.

Specifically, the side plate 16 is provided with a circumferential centering collar 18 on the side facing the passageway 14. In this instance, the side plate 16 is inserted with the centering collar 18 into bearing flange 4 or into passageway 14 in the region close to the radial seal 12.

The side plate 16 further includes a counter-rotation structure, which is shown schematically in FIG. 2 for the sake of a clear and yet simple illustration. Specifically, the counter-rotation structure includes projections, which are rigidly associated to the side plate 16. These projections engage corresponding recesses in the inside wall of the bearing flange, so that an unintentional rotation of the side plate 16 is effectively prevented.

At this point, it should be noted that both the passageway 14 and the bearing adjacent thereto, including the receptacle for centering collar 18 of side plate 16 can be made by means of a single tool, namely by means of a step tool. Due to the use of a step tool, there is no tolerance shift toward the centering collar. This simplifies assembly of the components quite considerably, while avoiding a tolerance shift.

Finally it should be emphasized that the foregoing embodiment which is merely given by way of example, describes only the teaching of the invention in greater detail, without however limiting it to the specific embodiment.

What is claimed is:

1. A rotary pump for delivering a fluid, comprising an annular casing having opposite sides, a casing cover closing one of the opposite sides of the casing and a bearing flange closing the other side of the casing, a passageway extending through said bearing flange, a rotary fluid delivery device mounted within said casing and including a drive shaft extending through said passageway in said bearing flange, a side plate disposed between the delivery device and an inside wall of the bearing flange for centering the delivery device in the casing, and said side plate including an at least essentially circumferential centering collar which is inserted into and engages the passageway for centering the side plate with respect to the passageway and the bearing flange.

2. The pump as defined in claim 1 further comprising a second side plate disposed between the delivery device and an inside wall of the casing cover.

3. The pump as defined in claim 2 wherein the drive shaft extends through the delivery device, through the second side plate, and through the casing cover, with the drive shaft extending through a bore in the casing cover which includes a bearing for the drive shaft.

4. The pump as defined in claim 1 wherein the side plate and the inside wall of the bearing flange include antirotation structure for precluding the rotation of the side plate.

5. The pump as defined in claim 4 wherein the antirotation structure comprises engagement means that are formed in the region of the centering collar.

6. The pump as defined in claim 5 wherein the engagement means comprises projections on the side plate which are received in respective recesses on the inside wall of the bearing flange.

* * * * *